US006755327B1

(12) United States Patent
Hazard et al.

(10) Patent No.: US 6,755,327 B1
(45) Date of Patent: Jun. 29, 2004

(54) DISPENSING PUMP WITH DEFORMABLE PUMP WALL AND POSITIVE SHUT-OFF

(75) Inventors: Robert E. Hazard, North Kingstown, RI (US); Frederick R. Handren, Arlington, VA (US)

(73) Assignee: Richard H. Davey, Inc., West Covina, CA (US)

( * ) Notice: Subject to any disclaimer, the term of this patent is extended or adjusted under 35 U.S.C. 154(b) by 39 days.

(21) Appl. No.: 10/230,383

(22) Filed: Aug. 29, 2002

Related U.S. Application Data

(60) Provisional application No. 60/315,332, filed on Aug. 29, 2001.

(51) Int. Cl.[7] ..... B65D 37/00
(52) U.S. Cl. ..... 222/209; 222/321.7
(58) Field of Search ..... 222/632, 633, 222/634, 209, 321.7

(56) References Cited

U.S. PATENT DOCUMENTS

| | | | | |
|---|---|---|---|---|
| 3,276,641 A | | 10/1966 | Lehmann | |
| 3,452,905 A | | 7/1969 | Micallef | |
| 4,088,248 A | | 5/1978 | Blake | |
| 4,201,317 A | | 5/1980 | Aleff | |
| 4,347,953 A | | 9/1982 | Bauer | |
| 4,679,712 A | | 7/1987 | Foster et al. | |
| 4,889,262 A | | 12/1989 | Toms | |
| 5,042,694 A | * | 8/1991 | Birmelin | 222/145.3 |
| 5,152,434 A | | 10/1992 | Birmelin | |
| 5,238,156 A | | 8/1993 | Andris | |
| 5,351,862 A | * | 10/1994 | Weag | 222/145.3 |
| 5,409,146 A | | 4/1995 | Hazard et al. | |
| 5,462,208 A | | 10/1995 | Stahley et al. | |
| 5,544,789 A | | 8/1996 | Gillingham | |

FOREIGN PATENT DOCUMENTS

FR 1.165.271 10/1958

* cited by examiner

*Primary Examiner*—Joseph A. Kaufman
(74) *Attorney, Agent, or Firm*—Frederick R. Handren

(57) ABSTRACT

A container-mounted dispensing pump incorporates an elastically deformable pump wall and elastomeric valves for controlling the flow into and from the pump chamber. A mechanism at the movable end of the deformable pump wall engages the outlet valve to effect positive closure thereof when the actuator is disposed in an extended, shipping position. With the pump actuator placed in the shipping position, the close outlet valve will preclude leakage of the container contents though the pump.

11 Claims, 6 Drawing Sheets

DISPENSING PUMP WITH DEFORMABLE PUMP WALL AND POSITIVE SHUT-OFF

CROSS-REFERENCE TO RELATED APPLICATIONS

This application claims priority under 35 U.S.C. 119 of U.S. Provisional Application No. 60/315,332 filed on Aug. 29, 2001, the entire disclosure of which is hereby incorporated by reference.

BACKGROUND OF THE INVENTION

1. Field of the Invention

The present invention is directed to a manually operated dispensing pump and more particularly to a container-mounted, finger-operated pump incorporating a deformable pump wall, elastomeric inlet and outlet valves and a positive shut-off.

2. Brief Description of Background Art

Container-mounted, finger-operated dispensing pumps are well known and are used for dispensing liquids having widely varying flow characteristics. The form of discharge from these pumps can vary from a fine spray to a slow moving flow.

Typically, container-mounted dispensing pumps employ fixed and movable pump members forming a variable volume pump chamber and one-way valves controlling the flow into and out of the pump chamber. Various types of one-way valves, including ball check valves and elastomeric valves, are employed in these dispensing pumps.

Many container-mounted dispensing pumps incorporate a feature which allows them to be placed in a "shipping" position to prevent leakage through the pump if they are upended or if the container contents become pressurized. A common pump of this type employs a reciprocable plunger which can be locked in a depressed position, holding a ball check valve closed to seal the pump against leakage. Applicants are not aware of dispensing pumps which incorporate a deformable pump wall and elastomeric pump valves and which can be placed in a shipping position to prevent leakage through the pump.

OBJECTS OF THE INVENTION AND SUMMARY

An object of the present invention is to provide a dispensing pump which operates reliably and which is inexpensive to manufacture.

Another object of the present invention is to provide a dispensing pump employing a deformable pump wall and elastomeric pump valves.

Yet another object of the present invention is to provide a container-mounted dispensing pump incorporating a deformable pump wall and a positive shut-off mechanism for an elastomeric pump valve which precludes leakage of the container contents through the pump.

The foregoing objects of the invention, and others as well, are realized in the dispensing pump of the present invention which incorporates a stationary pump member and a deformable pump wall having one end thereof engaging the stationary pump member with a sliding seal to thereby form a variable volume pump chamber, an elastomeric valve controlling the flow of liquid from the pump chamber and a positive shut-off mechanism for applying a positive closing force to the elastomeric valve to prevent leakage through the pump. In a preferred embodiment of the dispensing pump, at least part of the deformable pump wall is a self-restoring bellows.

The objects of the invention are also realized by a dispensing pump comprising: a pump base provided with means for attachment to a container of a liquid to be dispensed; an inlet passage extending through the pump base; an elastically deformable pump wall having (1) a stationary end sealed to the pump base about the inlet passage and (2) a movable end, the deformable pump wall surrounding and defining a variable volume pump chamber; an actuator with a dispensing head coupled to the movable end of the pump wall for movement therewith between (1) an extended position at which the volume of the pump chamber is enlarged and (2) a depressed position at which the volume of the pump chamber is reduced; a one-way inlet valve controlling the flow of liquid into the pump chamber through the inlet passage; means forming an outlet passage accommodating flow of liquid from the pump chamber to the dispensing head; an elastomeric one-way outlet valve controlling the flow of liquid from the pump chamber to the dispensing head through the outlet passage; and means for engaging and applying a closing force to the outlet valve in response to movement of the actuator to the extended position thereof.

In one embodiment of the dispensing pump, the elastomeric valve is an O-ring engaging a seat on the stationary pump member, and the shut off mechanism comprises a formation on the movable end of the pump wall that engages the O-ring when the volume of the pump chamber is enlarged to press the O-ring against its seat.

In another embodiment of the dispensing pump, the elastomeric valve is a duckbill valve carried on the stationary pump member, and the shut off mechanism comprises a formation on the movable end of the pump wall that engages movable pinching elements adjacent to the outlet end of the duckbill valve when the volume of the pump chamber is enlarged; the pinching elements, when engaged by the formation on the movable end of the pump wall, press the lips of the duckbill valve together to close the valve outlet passage.

In another embodiment of the dispensing pump, a segmented ring carried at the movable upper end of the deformable pump wall presses an O-ring into a valve seat controlling outlet passages through a formation at the upper end of the deformable pump wall.

All embodiments of the dispensing pump can also employ an elastomeric valve for controlling flow into the pump chamber, and this valve can be like the valve controlling the flow from the pump chamber, to minimize the number of different parts needed for assembly of the pump.

The positive shut-off mechanism can include a pump actuator coupled to the movable end of the deformable pump wall for movement therewith between extended and depressed positions corresponding, respectively, to enlarged and reduced volumes of the pump chamber. An element carried by the actuator can be moved to engage a formation on a stationary shroud about the pump for locking the actuator in the extended, shipping position.

The detailed description provided below together with the accompanying drawings will afford a further understanding of the present invention. Specific embodiments of the present invention which are disclosed herein should be regarded as illustrative and not restrictive of the scope of the invention.

DETAILED DESCRIPTION OF PREFERRED EMBODIMENTS

Figure 2:
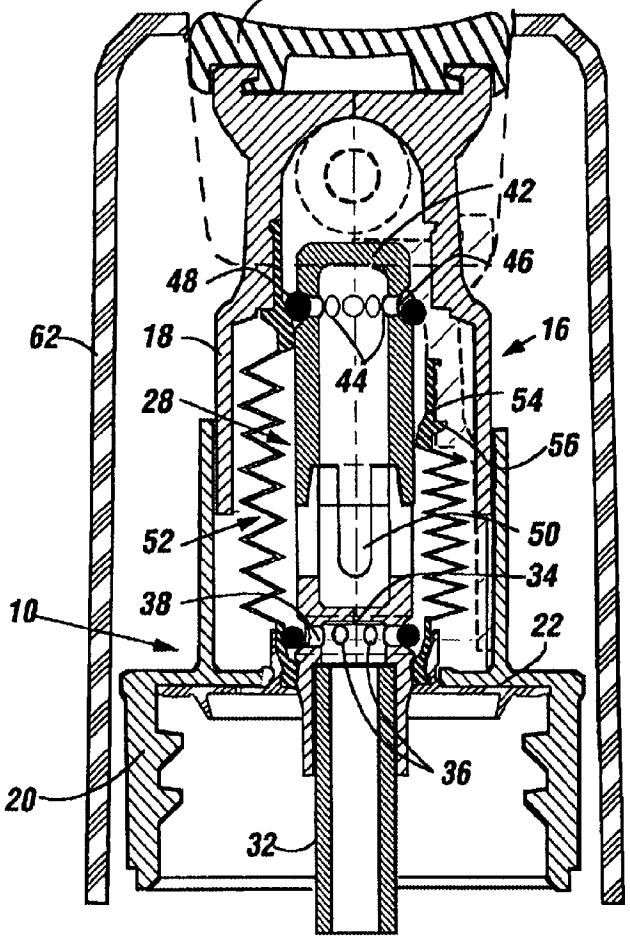
FIG. 2 is a split front cross-sectional view of the dispensing pump illustrated in FIG. 1, showing the pump actuator in both the extended and the depressed positions.
Figure 1:
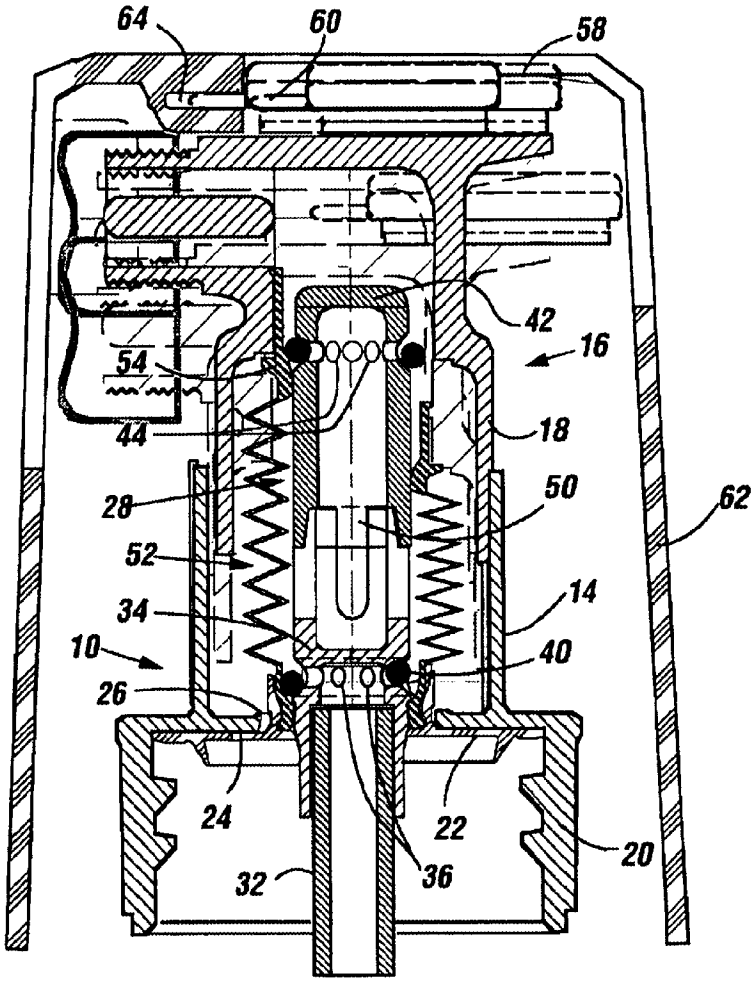
FIG. 1 is a split side cross-sectional view of a dispensing pump constructed according to the teachings of the present invention, showing the pump actuator in both the extended and the depressed positions.

Referring to FIGS. 1 and 2, a dispensing pump incorporating the present invention includes a pump base 10 having a horizontal wall 12 and an upstanding collar 14 that receives the lower end of a skirt 18 of actuator 16. Extending downwardly from the horizontal wall is an internally threaded skirt 20 that provides a means for attachment of the dispensing pump to the threaded neck of a container (not shown) of liquid to be dispensed. A seal 22 for the container neck underlies the horizontal wall. The seal may include a small flap 24 that provides one-way valving for a venting passage 26 through the horizontal wall.

Sealed within a central opening through the horizontal wall 12 is the lower end of a stationary pump member 28. A transverse wall 34 extends across the interior of the lower end of the stationary pump member. Below the wall 34 are openings 36 extending through the tubular wall of the stationary pump member and into an encircling groove 38 in the outer surface of the tubular wall. Fitting snugly in the groove is an O-ring 40 that acts as a one-way elastomeric valve controlling flow through the openings 36 from the inside to the outside of the stationary pump member. A dip tube 32 for conducting liquid from the container to the dispensing pump is fitted within the lower-end of the stationary pump member. The upper end of the stationary pump member is closed by a transverse wall 42. Below the wall 42 are openings 44 that extend through the tubular wall of the stationary pump member and into an encircling groove 46 in the outer surface of the tubular wall. Fitting snugly in the groove is an O-ring 48 that acts as a one-way elastomeric valve controlling flow through the openings 44 from the inside to the outside of the stationary pump member. Between the openings 44 and the lower transverse wall 34 are openings 50 that extend through the tubular wall of the stationary pump member and provide a fluid path between the outside and the inside of the stationary pump member.

Sealed about the lower end of the stationary pump member below the openings 36 is the stationary lower end of an elastically deformable pump wall 52. As shown, the pump wall is a self-restoring bellows. The movable upper end of the deformable pump wall includes a collar 54 that slidably engages the tubular wall of the stationary pump member. On the inside of the collar is a beveled cam formation 56 adapted to engage the O-ring 48 when the collar is at the uppermost limit of its travel along the tubular wall of the stationary pump member. The collar is joined to the actuator 16 for movement therewith between extended and depressed positions thereof.

As shown in FIGS. 1 and 2, the upper end of the actuator carries a finger pad 58 that can slide forwardly and rearwardly on the actuator. Extending from the front of the finger pad is a tab 60. In a shroud 62 disposed about the dispensing pump is a recess 64 that receives the tab 60 when the finger pad is in its forward position. The engagement of the tab in the recess locks the actuator against movement from the extended position theredf. Movement of the finger pad rearwardly to a non-locking position effects withdrawal of the tab from the recess and frees the actuator for movement from its extended position.

The resiliency of the deformable pump wall 52 biases the actuator 16 to its extended position. If necessary, this biasing force can be augmented by a compression spring acting between the pump base 10 and the actuator. With the finger pad 58 in its non-locking position, a downward force applied to the finger pad effects downward movement of the actuator to its depressed position. The collar 58 at the upper end of the deformable pump wall, moving with the actuator, effects a reduction in the size of a variable volume pump chamber formed between the stationary pump member 28 and the deformable pump wall. Liquid contained within the pump chamber will be pressurized and will exit from the pump chamber through the openings 44 and past the O-ring 48. When the downward force on the actuator is relieved, the resiliency of the deformable pump wall will effect upward movement of the actuator and the collar toward their extended positions. Upward movement of the collar enlarges the pump chamber, creating a low pressure state within, that draws liquid into the pump chamber through openings 36 and past O-ring 40. When the actuator is in its extended position, the cam formation 56 engages O-ring 48, urging it into seating engagement in groove 46 to effect a positive closure of the openings 44 that form the outlet from the pump chamber. If the finger pad 58 is then moved forwardly to its locking position, the dispensing pump will be placed in a shipping position, which precludes leakage of liquid from the container through the dispensing pump.

Figure 3:
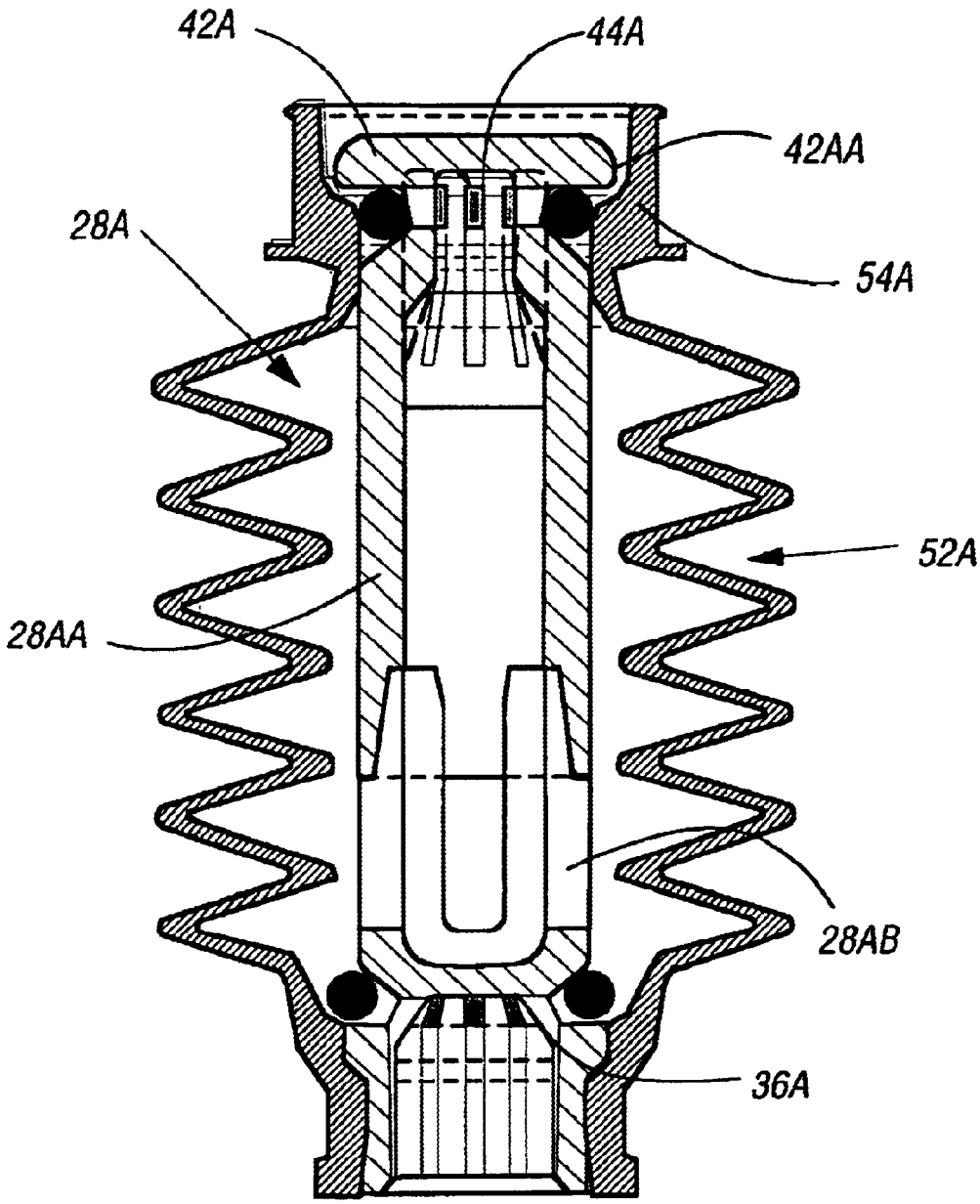
FIG. 3 is a cross-sectional view showing details of a modified stationary pump member and a modified bellows pump wall employed in a dispensing pump constructed according to the teachings of the present invention.
Figures 4A, 4B, 4C:
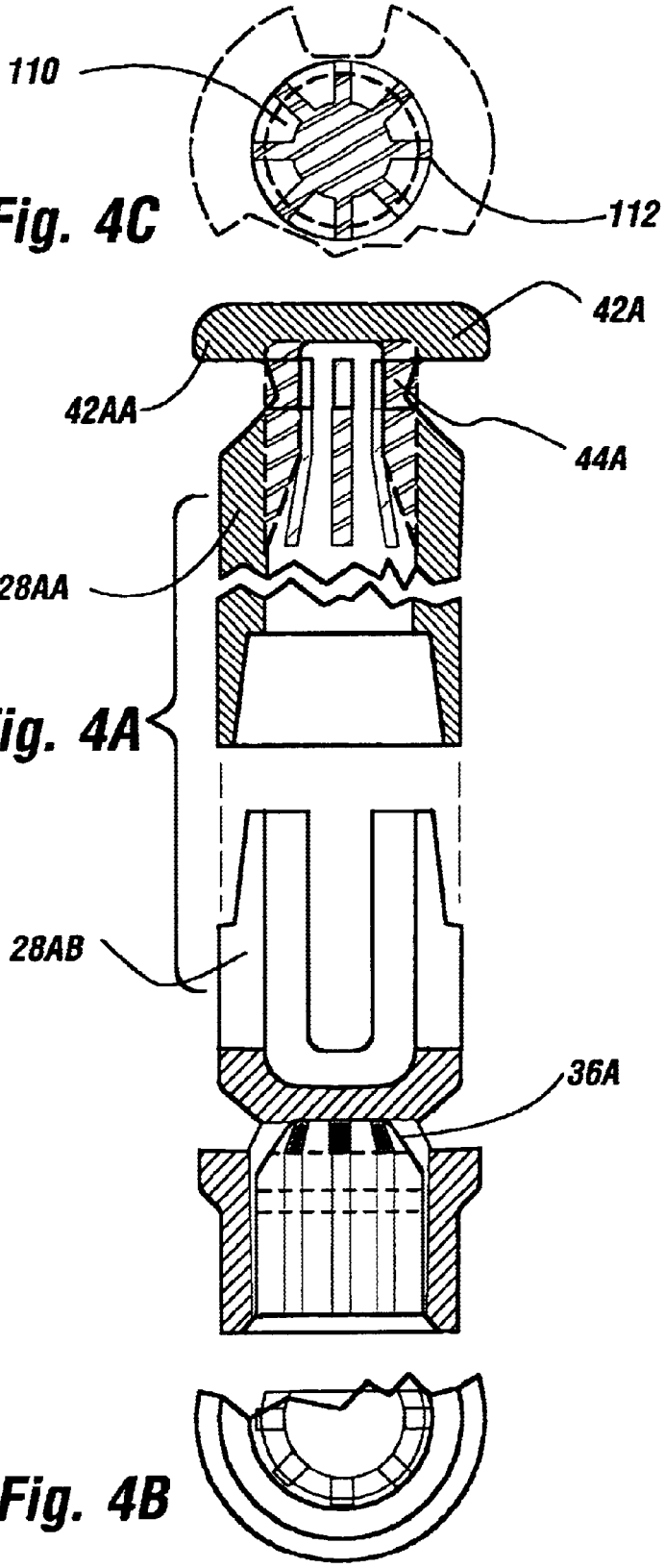
FIG. 4A is a an exploded cross-sectional view of the stationary pump member illustrated in FIG. 3.
FIG. 4B is a partial sectional bottom view of the lower section of the stationary pump member illustrated in FIG. 3
FIG. 4C is a partial phantom top view of the upper section of the stationary pump member illustrated in FIG. 3 showing in cross-section the mold core pin used to form openings through the valve seat in the upper section of the stationary pump member.

To facilitate molding of the stationary pump member, a modified form of the stationary pump member and the deformable pump wall may be used. As shown in FIGS. 3 and 4, the modified stationary pump member 28A includes inter-fitted upper and lower sections 28AA and 28AB having slots 36A and 44A, forming the pump chamber inlet and outlet passages, respectively. The slots can be easily formed in an injection molding set-up that includes splined core pins 110 with the splines 112 thereof engaging the surface of the outer mold cavity at the location of the openings. (See especially FIG. 4C.) As a safeguard against dislodgement of O-ring 48 from groove 46, the upper wall 42A of the stationary pump member includes a flange 42AA that overhangs the O-ring. In this embodiment, the inside of the collar 54A at the upper end of the deformable pump wall 52A is generally cylindrical and fits with a slight interference over the O-ring.

Figure 5A:
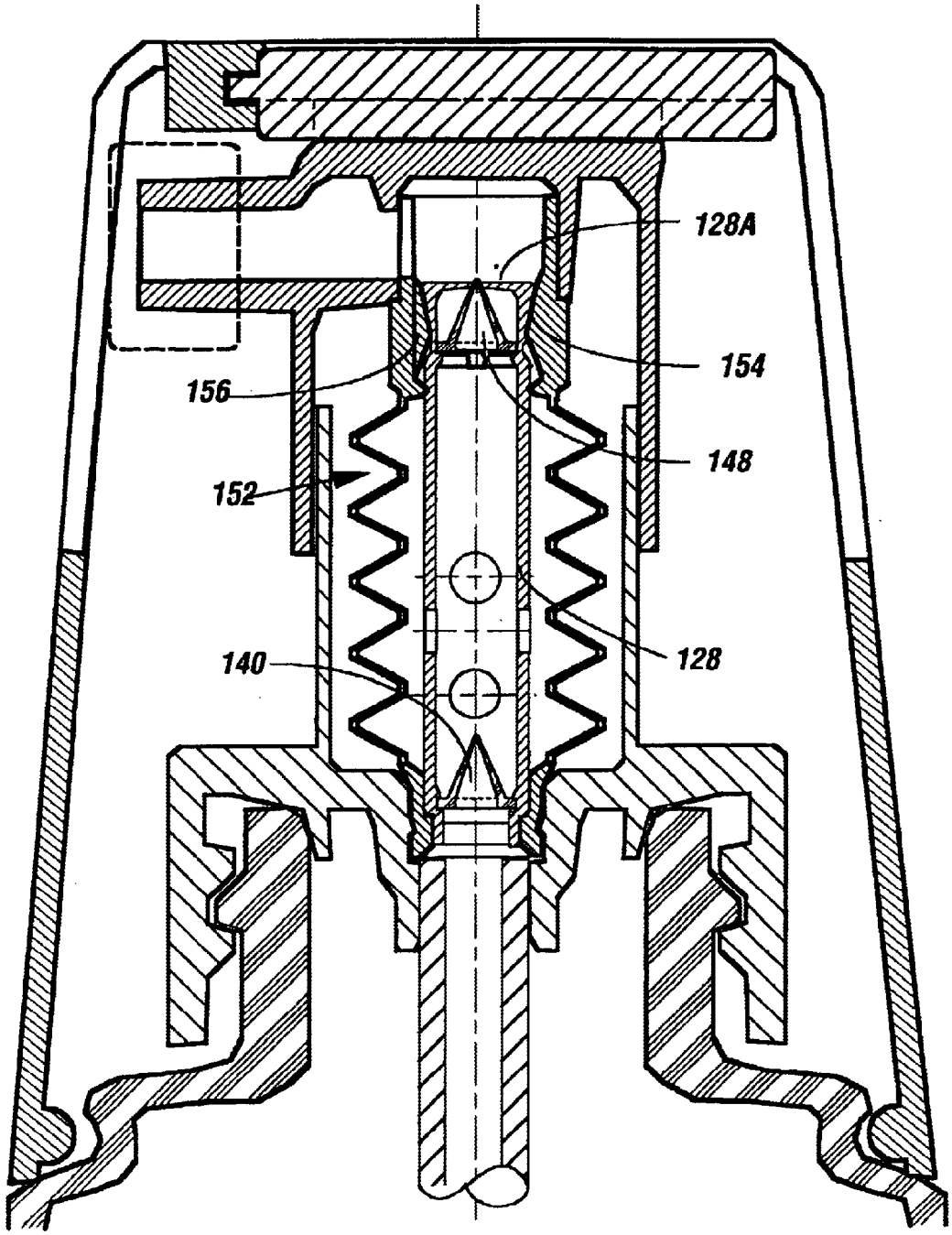
FIG. 5A is a side cross-sectional view of another embodiment of a dispensing pump constructed according to the teachings of the present invention, showing the pump actuator in an extended position.
Figure 5B:
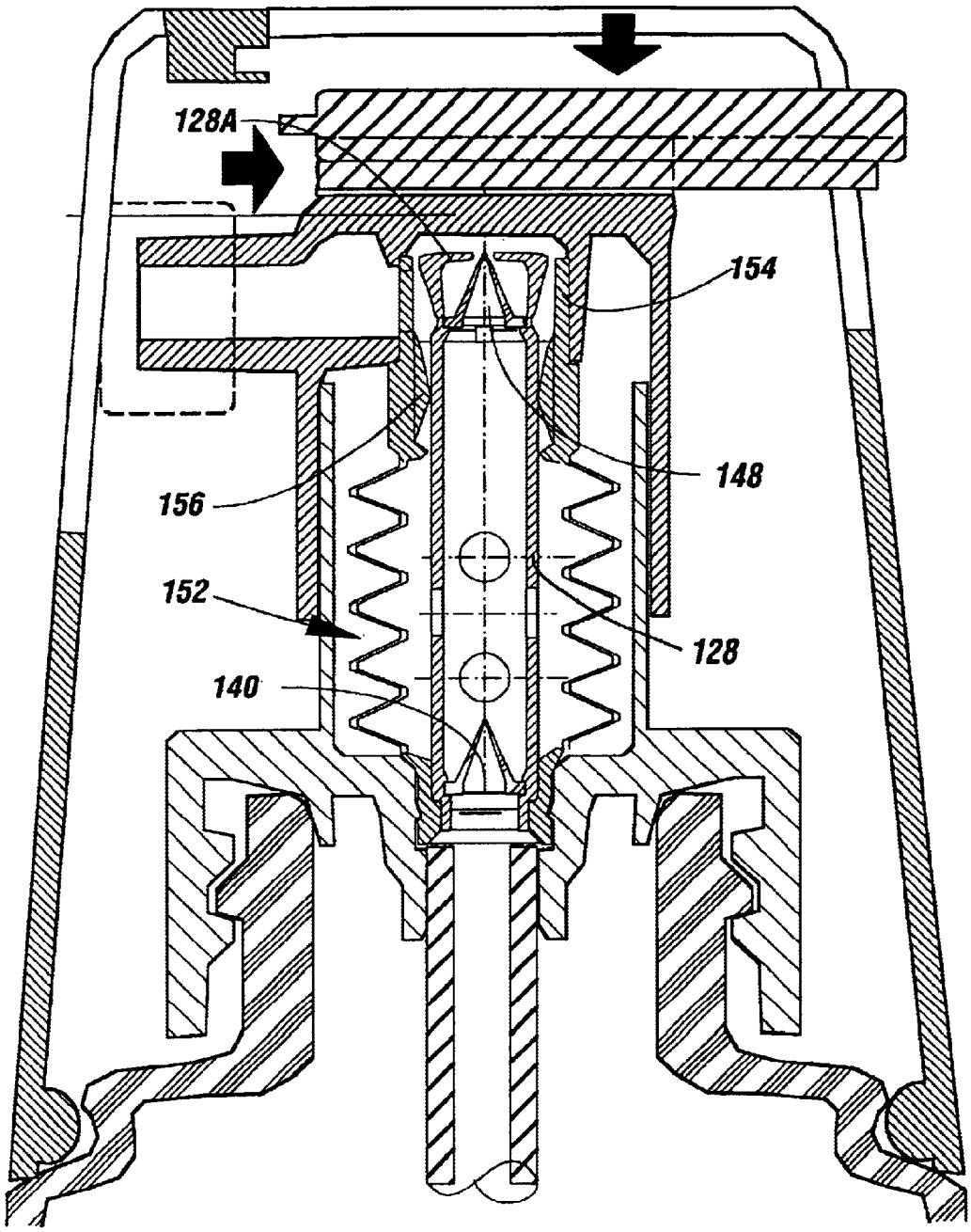
FIG. 5B is a side cross-sectional view of the dispensing pump illustrated in FIG. 5A, showing the pump actuator in a depressed position.
Figure 7A:
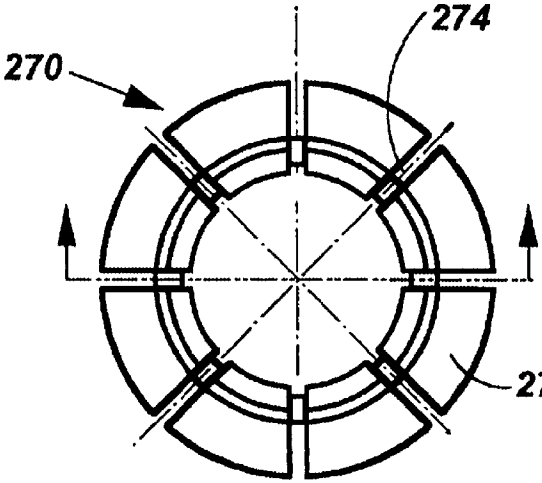
FIG. 7A is a plan view of a segmented closure ring employed in the dispensing pump illustrated in FIG. 6.
Figure 7B:
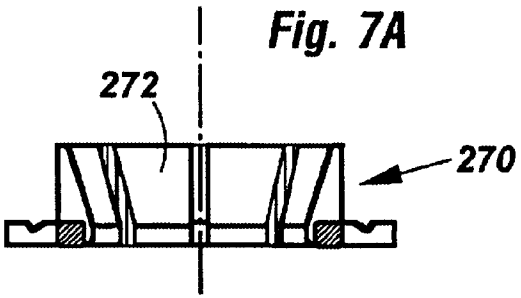
FIG. 7B is a cross-sectional view of the segmented closure ring employed in the dispensing pump illustrated in FIG. 6.

A modification of the dispensing pump shown in FIGS. 5A and 5B incorporates a tubular stationary pump member 128, a bellows-type deformable pump wall 152 and one-way elastomeric duckbill valves 140 and 148 controlling flow through the pump chamber inlet and outlet passages. The inside of collar 154 at the upper end of the deformable pump wall includes a cam formation (or formations) 156 that engage hinged pinching elements 128A at the upper end of the stationary pump member when the collar is in its extended position. The engagement of the cam formations with the pinching elements presses the pinching elements against the tip of duckbill valve 148 to positively close the slit passage through the valve and place the dispensing pump in a shipping position, which precludes leakage of liquid from the container through the dispensing pump.

Figure 6:
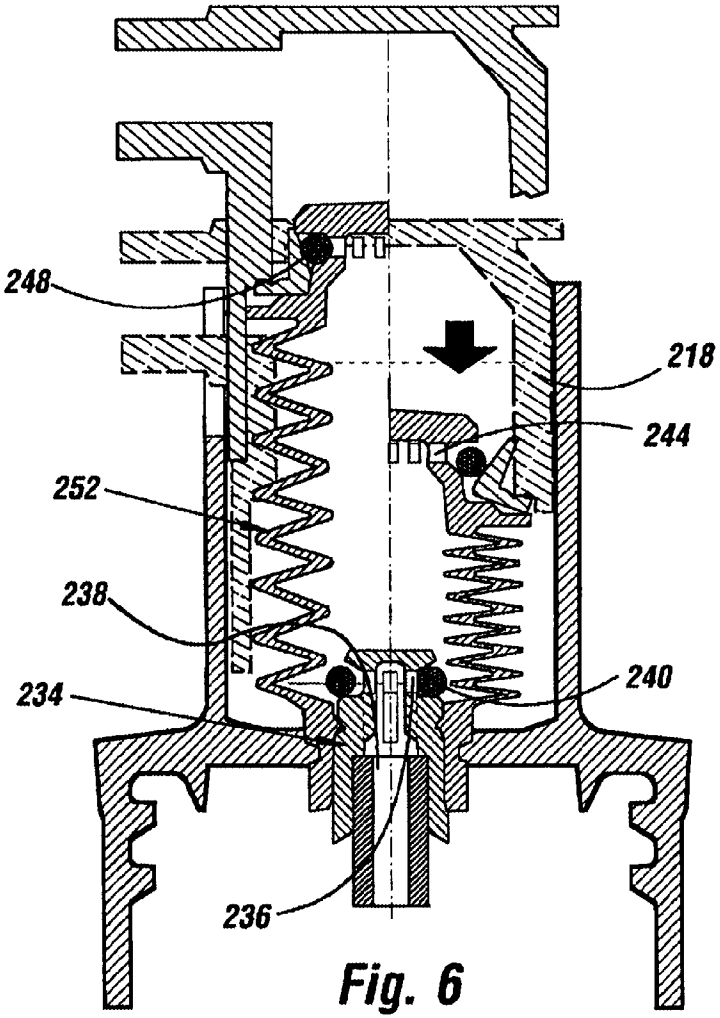
FIG. 6 is a split side cross-sectional view of another embodiment of a dispensing pump constructed according to the teachings of the present invention, showing the pump actuator in both the extended and the depressed positions.

FIG. 6 shows another embodiment of a dispensing pump constructed according the teachings of the present invention. In this embodiment, the sliding seal is eliminated, and the volume of the pump chamber can be made greater. As illustrated, the lower end of deformable wall 252 is sealed about an inlet fitting 234 receiving the upper end of a dip tube extending into a container on which the pump is mounted. (Although not shown, the pump base may incorporate a seal for the container neck and a valved venting passage, as in the embodiment of FIGS. 1 and 2.) A central inlet passage through the inlet fitting communicates with the pump chamber within the deformable wall 252 via 236. An O-ring in a groove 238 encircling the fitting 234 controls the flow through the inlet fitting and into the pump chamber. Radial outlet passages 244 in a formation at the movable upper end of the deformable wall extend from the pump chamber into a groove forming a valve seat for an O-ring 248 controlling flow from the pump chamber through passages 244 to the dispensing head 218. Disposed about the O-ring 248 is a ring 270 with elastically deformable segments 272 that bear inwardly against the O-ring 248, pressing the O-ring into the valve seat toward a position closing the outlet passages. The segments are joined to each other by relatively thin webs that allow tilting movement of the segments and also permit the elastic enlargement of the ring 270 needed for assembling the ring onto the formation at the movable upper end of the deformable wall 252. The L-shaped cross-section of the segments 272 presents outwardly extending surfaces of the segments to the lower end of the dispensing head. During downward movement of the dispensing head, the engagement of the dispensing head with the outwardly extending surfaces of the segments causes outward tilting of the segments away from the O-ring, allowing the O-ring to move away from its seat to open the passages 244 to flow from the pump chamber. Upward movement of the dispensing head relaxes the downward force applied by the dispensing head to the outwardly extending surfaces of the segments, whereby the segments will move inwardly due to the elasticity of the ring 270 and press the O-ring 248 into its valve seat. As a consequence, the outlet passages will be tightly closed by the O-ring 248 when the dispensing head is disposed in its extended position.

Various modifications of the present invention may be obvious to persons of ordinary skill in the art having the benefit of this disclosure. All such modifications are to be regarded as falling within the scope of the invention as defined in the following claims.

what is claimed is:

1. A dispensing pump comprising:

a pump base provided with means for attachment to a container of a liquid to be dispensed;

a stationary pump member carried by the pump base;

an elastically deformable pump wall disposed about the stationary pump member, a stationary end of the pump wall being sealed to the stationary pump member and a movable end of the pump wall engaging the stationary pump member with a sliding seal, whereby the stationary pump member and the pump wall form a variable volume pump chamber;

an actuator with a dispensing head coupled to the movable end of the pump wall for movement therewith between (1) an extended position at which the volume of the pump chamber is enlarged and (2) a depressed position at which the volume of the pump chamber is reduced;

means forming an inlet passage accommodating flow of liquid into the pump chamber;

means forming an outlet passage accommodating flow of liquid from the pump chamber to the dispensing head;

a one-way inlet valve controlling the flow of liquid into the pump chamber through the inlet passage;

an elastomeric one-way outlet valve controlling the flow of liquid from the pump chamber to the dispensing head through the outlet passage; and means for engaging and applying a closing force to the outlet valve in response to movement of the actuator to the extended position thereof.

2. The dispensing pump as recited in claim 1, wherein the pump wall comprises a self-restoring bellows.

3. The dispensing pump as recited in claim 1, wherein the outlet valve comprises an O-ring engaging a valve seat on the stationary pump member.

4. The dispensing pump as recited in claim 3, wherein the inlet valve comprises an O-ring engaging a valve seat on the stationary pump member.

5. The dispensing pump as recited in claim 1 and further comprising means for locking the actuator against movement from the extended position to the depressed position.

6. A dispensing pump comprising:

a pump base provided with means for attachment to a container of a liquid to be dispensed;

an inlet passage extending through the pump base;

an elastically deformable pump wall having (1) a stationary end sealed to the pump base about the inlet passage and (2) a movable end, the deformable pump wall surrounding and defining a variable volume pump chamber;

an actuator with a dispensing head coupled to the movable end of the pump wall for movement therewith between (1) an extended position at which the volume of the pump chamber is enlarged and (2) a depressed position at which the volume of the pump chamber is reduced;

a one-way inlet valve controlling the flow of liquid into the pump chamber through the inlet passage;

means forming an outlet passage accommodating flow of liquid from the pump chamber to the dispensing head;

an elastomeric one-way outlet valve controlling the flow of liquid from the pump chamber to the dispensing head through the outlet passage; and means for engaging and applying a closing force to the outlet valve in response to movement of the actuator to the extended position thereof.

7. The dispensing pump as recited in claim 6, wherein the pump wall comprises a self-restoring bellows.

8. The dispensing pump as recited in claim 6, wherein the inlet passage is formed in an inlet fitting carried by the pump base, and the inlet valve comprises an O-ring engaging a valve seat formed in the inlet fitting.

9. The dispensing pump as recited in claim 6, wherein the outlet valve comprises an O-ring engaging a valve seat formed in the movable end of the deformable wall.

10. The dispensing pump as recited in claim 9, and further comprising a closure ring with movable segments disposed about the outlet valve O-ring, the closure ring having a surface thereof engageable with the actuator, whereby (1) movement of the actuator toward the depressed position effects movement of the segments outwardly to allow movement of the O-ring away from the valve seat, and (2) movement of the actuator to the extended position allows the segments to move inwardly to press the O-ring into the valve seat.

11. The dispensing pump as recited in claim 6, and further comprising means for locking the actuator against movement from the extended position to the depressed position.

* * * * *